US008870607B2

(12) United States Patent
Lappoehn

(10) Patent No.: US 8,870,607 B2
(45) Date of Patent: Oct. 28, 2014

(54) PLUG-IN CONNECTOR

(75) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 94 days.

(21) Appl. No.: 13/817,230

(22) PCT Filed: Aug. 16, 2011

(86) PCT No.: PCT/DE2011/001596

§ 371 (c)(1),
(2), (4) Date: Mar. 12, 2013

(87) PCT Pub. No.: WO2012/022302

PCT Pub. Date: Feb. 23, 2012

(65) Prior Publication Data

US 2013/0183865 A1 Jul. 18, 2013

(30) Foreign Application Priority Data

Aug. 18, 2010 (DE) ..... 10 2010 034 789

(51) Int. Cl.

| | |
|---|---|
| ***H01R 13/514*** | (2006.01) |
| ***H01R 13/428*** | (2006.01) |
| ***H01R 13/436*** | (2006.01) |
| ***H01R 13/40*** | (2006.01) |
| *H01R 4/18* | (2006.01) |

(52) U.S. Cl.

CPC ..... *H01R 13/40* (2013.01); *H01R 4/185* (2013.01); *H01R 13/428* (2013.01); *H01R 13/4362* (2013.01); *H01R 2201/26* (2013.01)

USPC ..... 439/752

(58) Field of Classification Search

USPC ..... 439/752, 595

See application file for complete search history.

(56) References Cited

U.S. PATENT DOCUMENTS

| | | | |
|---|---|---|---|
| 6,478,632 | B2 | 11/2002 | Tanaka |
| 7,413,485 | B2 | 8/2008 | Lappoehn |

(Continued)

FOREIGN PATENT DOCUMENTS

| | | |
|---|---|---|
| DE | 601 07 481 | 11/2005 |
| DE | 10 2006 030 784 | 1/2008 |

(Continued)

OTHER PUBLICATIONS

International Search Report of PCT/DE2011/001596, date of mailing Jan. 31, 2012.

(Continued)

*Primary Examiner* — Phuong Dinh

(74) *Attorney, Agent, or Firm* — Collard & Roe, P.C.

(57) ABSTRACT

Disclosed is a plug-in connector (100) comprising at least one contact element (200) arranged in a base element (110) of the plug-in connector, and a crimp connection. At least one secondary locking recess (205, 206) is arranged in the contact element (200), extending transverse to the plug-in direction (R). A locking stud (305, 306) of a secondary locking element (300) engages with the secondary locking recess (205, 206) in the locked position of the secondary locking element (300). The disclosed plug-in connector (100) is characterized by a fixing element (215) which is arranged at the end of a crimp region and which engages with a mating recess (115) in the base element (110) of the plug-in connector.

11 Claims, 7 Drawing Sheets

(56) References Cited

U.S. PATENT DOCUMENTS

Figure 1:
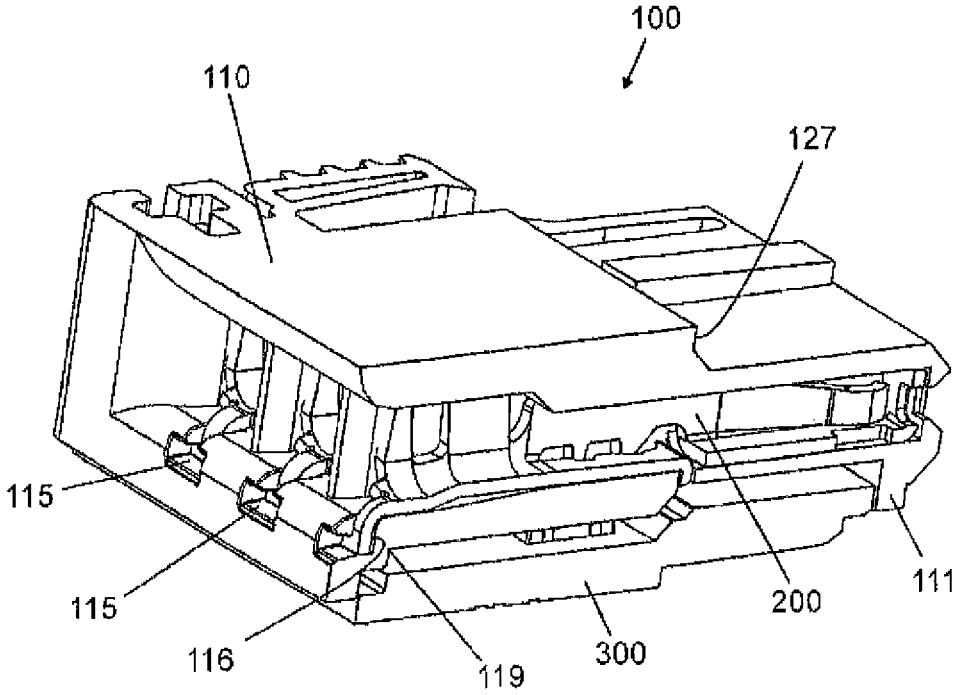

| | | | | |
|---|---|---|---|---|
| 7,517,247 | B2 * | 4/2009 | Hiramatsu | 439/595 |
| 2012/0137403 | A1 * | 6/2012 | Bone et al. | 2/163 |

FOREIGN PATENT DOCUMENTS

| | | |
|---|---|---|
| EP | 1 150 388 | 10/2001 |
| JP | 63-134476 | 9/1988 |
| JP | 63 134476 | 9/1988 |
| JP | H01 121273 | 4/1989 |
| JP | H01-121273 | 4/1989 |

OTHER PUBLICATIONS

International Preliminary Report on Patentability of PCT/DE2011/001596 dated Feb. 28, 2013.

German Office Action in DE 10 2010 034 789.2 dated Jun. 22, 2011, with English translation of relevant parts.

* cited by examiner

PLUG-IN CONNECTOR

CROSS REFERENCE TO RELATED APPLICATIONS

This application is the National Stage of PCT/DE2011/001596 filed on Aug. 16, 2011, which claims priority under 35 U.S.C. §119 of German Application No. 10 2010 034 789.2 filed on Aug. 18, 2010, the disclosure of which is incorporated by reference. The international application under PCT article 21(2) was not published in English.

This invention concerns a plug-in connector as per the type of independent claim 1.

PRIOR ART

A generic plug-in connector is disclosed by DE 10 2006 030 784 A1. In this plug-in connector, a contact element arranged in a base element of the plug-in connector is maintained by means of a secondary locking. To this end, at least one secondary locking recess extending transversely to the plug-in direction is arranged, in which a locking stud of a secondary locking element engages with the locked position of the secondary locking element. The contact element of this plug-in connector features a crimp flag which serves to contact a bared electrical conductor.

Such connectors are also employed in the motor vehicle sector. In motor vehicles, the connectors and, in particular, the crimp connections of the conductors are exposed to considerable loading, such as vibrating loads, vibration levels, and the like. This leads to considerable loading of the transition section between blade or spring contacts and the crimp region. These vibrations can cause fractures, by way of example. Moreover, it has been established that due to big vibrations, a contact corrosion of the copper conductor in the crimp connection can occur, with an insulating effect and therefore increasing resistance to an unacceptable extent.

The underlying task of the present invention is therefore to develop further such plug-in connector in a way so that the disadvantages described above will not occur, and, in particular, that such plug-in connector can also be exposed to considerable vibrating loads and/or vibration levels, such as they occur in motor vehicles.

This task is solved by the features mentioned in independent claim 1.

DISCLOSURE OF THE INVENTION

The plug-in connector as per the invention is characterised by a fixing element which is arranged at the end of a crimp region and which engages with a mating recess in the base element of the plug-in connector.

The basic concept of the invention is to not only secure and fix the plug-in connector by means of the primary and secondary locking, but to provide for a fixing element that is arranged at a maximum distance possible from the secondary locking element, and thus secures a fixing of the contact element in two points of the base element of the plug-in connector and, in particular, a fixing of the crimp region of the contact element.

In this process, an arrest of this fixing element in the mating recess in the locked position of the secondary locking element is allowed for so that eventually, by actuating the secondary locking element, at the same time a fixing and arrest of the fixing element in the recess of the base element of the plug-in connector is achieved also in a very advantageous manner.

Advantageous further developments and designs of the plug-in connector as per the invention are the object of the subclaims referenced under claim 1.

One of the advantageous designs thus provides for at least one secondary locking recess being formed in a cone-shaped manner and the locking stud being (slightly) oversized in relation to this secondary locking recess, so that, at the moment of the secondary locking stud engaging with the secondary locking recess, a clamping of the locking stud in the secondary locking recess is produced, with a simultaneous movement of the contact element in the base element of the plug-in connector, parallel to the plug-in direction, At the moment of the locking stud engaging with the secondary locking recess, first a minimal movement of the contact element in the base element of the plug-in connector, parallel to the plug-in direction, is thus produced, and then the contact element is secured in the base element of the plug-in connector through a complete engagement of the stud with the secondary locking recess.

In this process, the fixing element together with the mating recess has the very advantageous effect of the fixing element, through the movement of the contact element in the plug-in direction described above, taking its bearing at a surface of the mating recess in the base element of the plug-in connector, by executing a bias.

Through such biased positioning, a shakeproof and vibration-free arrest of the contact element in the base element of the plug-in connector is achieved.

Purely as a matter of principle, arranging the fixing element on the contact element can be performed in most different ways.

One very advantageous embodiment allowing also for easy contacting of the conductor in the crimp region of the contact element, in particular, provides for the fixing element to be arranged at a deflection extending perpendicularly to the plug-in direction. By means of such arrangement, not only is the maximal opening cross section prepared for taking the conductor into the crimp region, but the deflection even serves as inlet guide for the conductor into the crimp region, as in case of wrong positioning of the conductor, the latter is run along the deflection until reaching the crimp region.

The deflection preferably encloses an angle of 90° with the plug-in direction. It is, however, also possible to form an angle of slightly less than 90°. An angle of 90° will allow for the best forming of a bearing.

The fixing element itself is preferably T-shaped in essence. Through this, a lateral fixing, that is, one that takes effect perpendicularly to the plug-in direction, is also achieved in a very advantageous manner, due to the mating formation in the base element of the plug-in connector.

According to one advantageous embodiment, a detent spring is arranged at the contact element for compression in a primary locking recess provided in the base element of the plug-in connector.

The extraction force can be adjusted to any extraction force requirements specified by means of a variation of the number of recesses with which the locking studs of the secondary locking element engage each time in the locked position of the secondary locking element. This is how very high extraction forces of, for instance, 100 Newton or more can be achieved as well.

One embodiment provides for a secondary locking element recess in the base element of the plug-in connector, taking in the secondary locking element in locked position. By applying this measure in locked position, the secondary locking element becomes integral part of the plug-in connector.

One particularly advantageous embodiment provides for the secondary locking element featuring a coding surface at the leading end, which prevents the plug-in connector from plugging if the secondary locking element is placed outside the locked position. Such measure increases the safety of the plug-in connection. Plugging the plug-in connector as per the invention into the second plug-in connector corresponding to the plug-in connector as per the invention is possible only if the secondary locking element is placed in locked position.

In this process, one advantageous embodiment provides for at least one coding rib being arranged in plug-in direction in the front area of the secondary locking element. The coding rib prevents a wrong plug-in connection being established if the secondary locking element is placed in locked position.

DRAWINGS

Examples of embodiments of the invention are shown in the drawings and explained in more detail in the following description.

Figure 2:
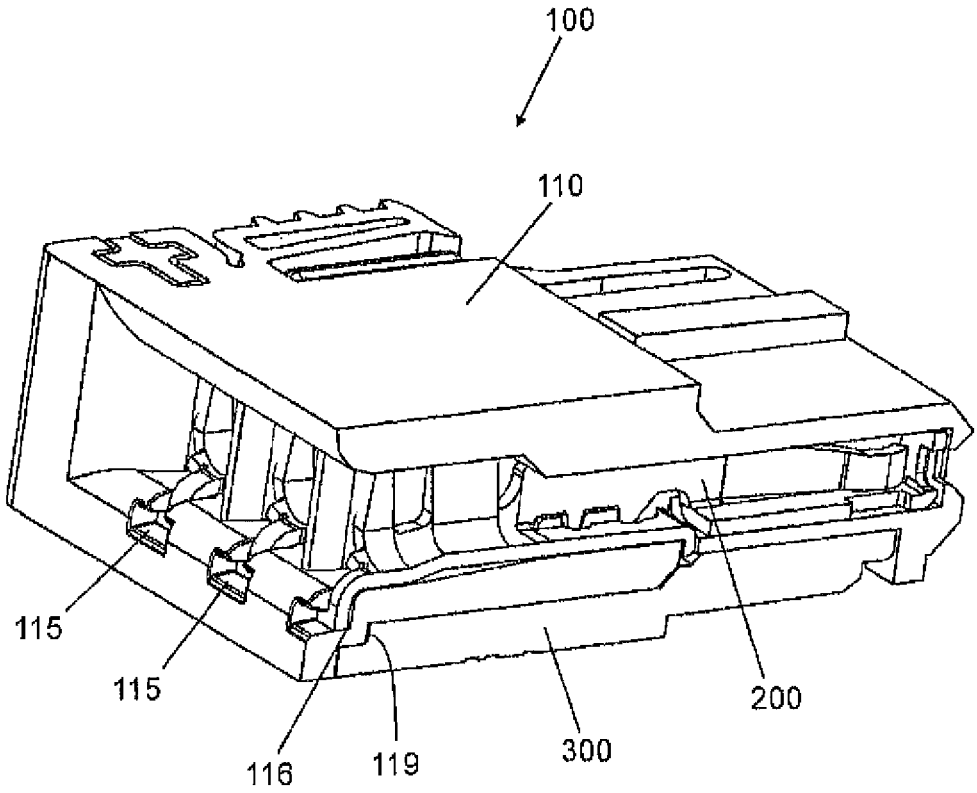
Figure 3:
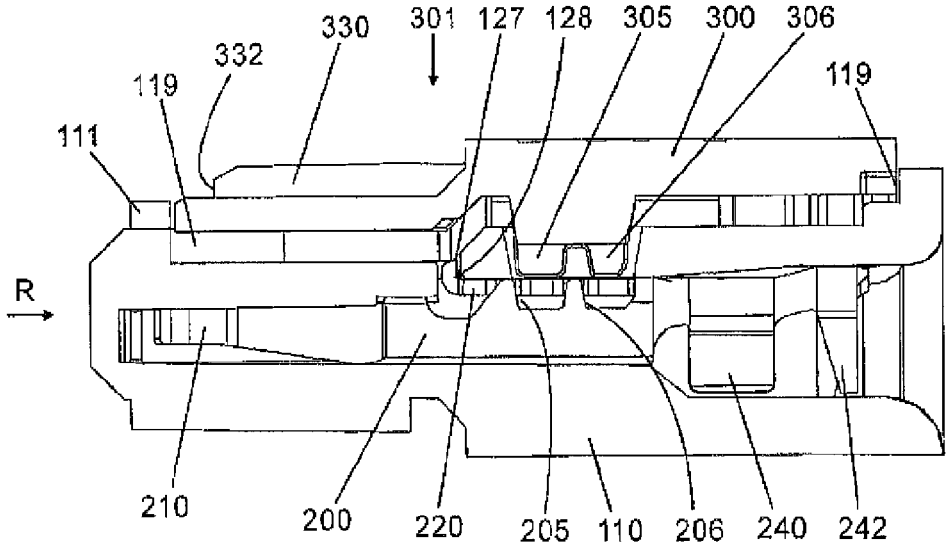
Figure 4:
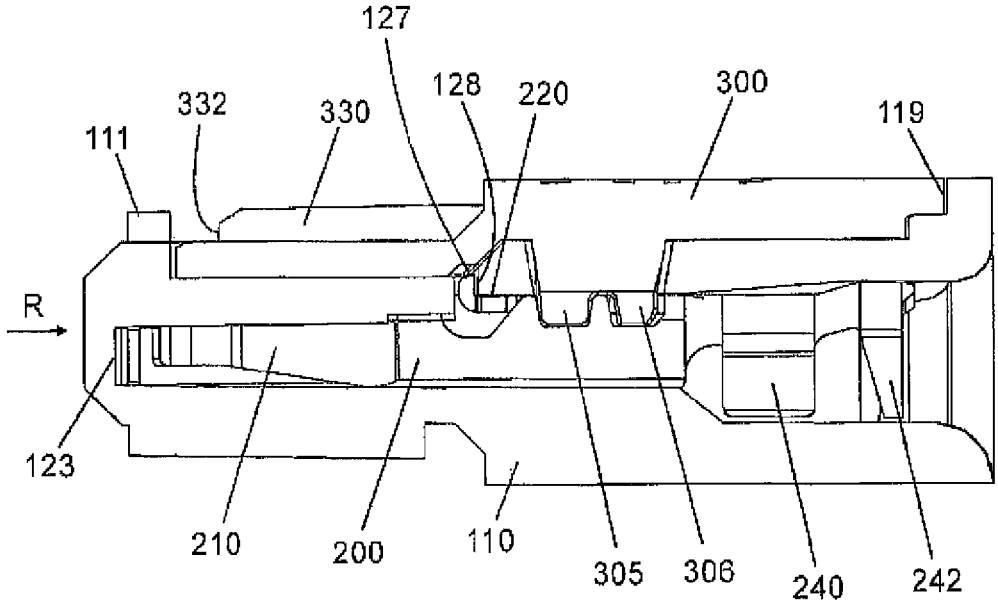
Figure 5:
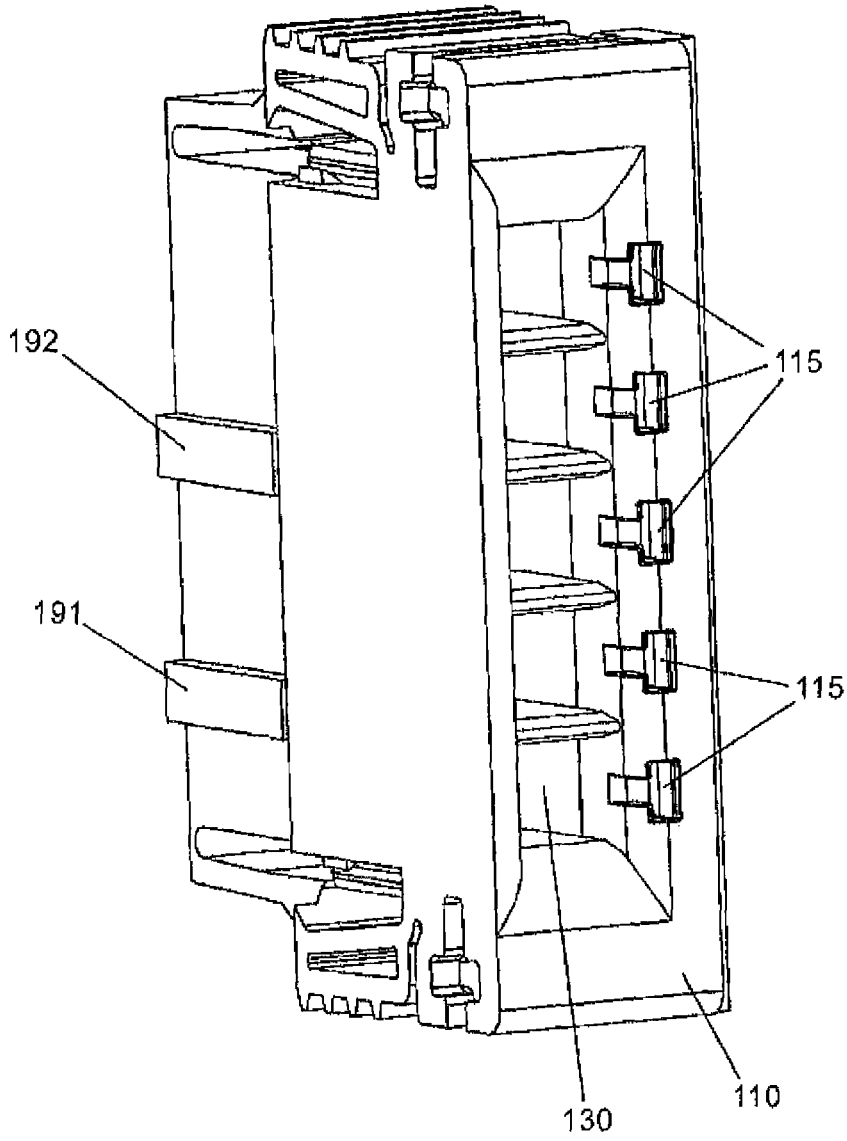
Figure 6:
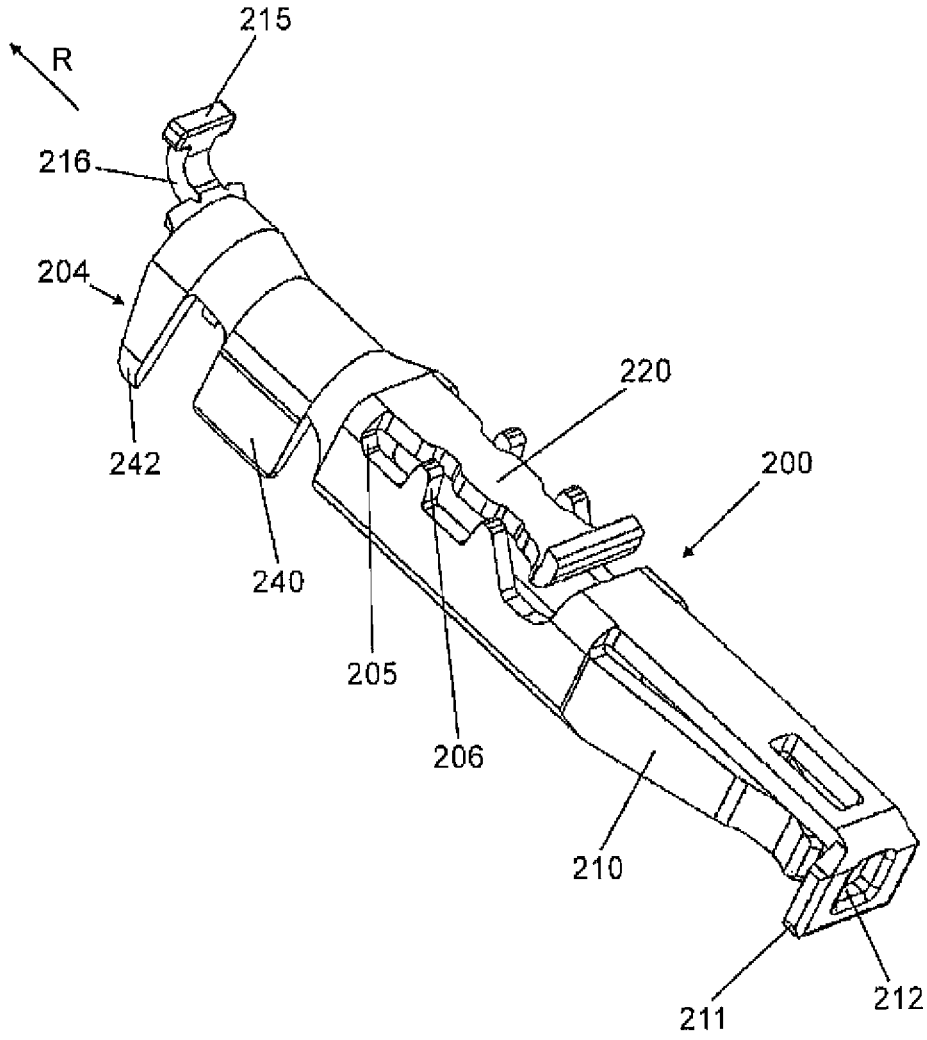

Are disclosed in:

FIG. 1 an isometric sectional representation of a plug-in connector as per the invention, with a non-locked secondary locking element;

FIG. 2 the isometric representation of the plug-in connector represented in FIG. 1, with a locked secondary locking element;

FIG. 3 a lateral sectional view of a plug-in connector as per the invention, prior to locking of the secondary locking element;

FIG. 4 the lateral sectional view represented in FIG. 3, with locked position of the secondary locking element;

FIG. 5 an isometric representation of the base element of the plug-in connector;

FIG. 6 an isometric representation of the contact element; and

Figure 7:
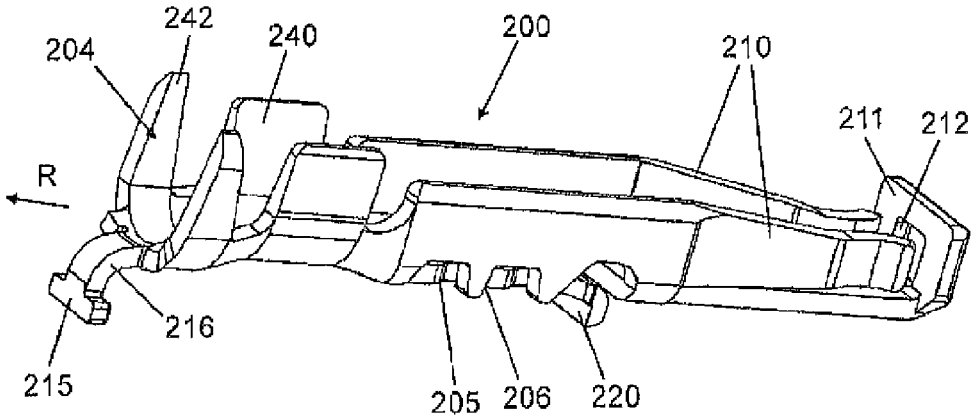

FIG. 7 an isometric representation of the contact element, from another view.

DESCRIPTION OF EXAMPLES OF EMBODIMENTS

A plug-in connector designated by 100 as a whole, represented in FIGS. 1 to 4 in different views, features a base element of the plug-in connector 110, consisting of an insulating material, in particular plastics. In this base element of the plug-in connector 110, a contact element 200 is arranged. Furthermore, a secondary locking element 300 is arranged in the base element of the plug-in connector 110, with the secondary locking element 300 featuring locking studs 305, 306 that engage with secondary locking recesses 205, 206 of the contact element 200 in locked position (FIG. 2, FIG. 4). As can be seen in FIG. 3 and FIG. 4, in particular, the secondary locking recess 205, 206 is formed in a cone-shaped manner, whilst at least one locking stud 305 is (slightly) oversized compared to the secondary locking recess 205, which means that it is a bit larger than the secondary locking recess 205. The effect of the cone-shaped design of the secondary locking recesses 205, 206 is that, at the moment of the locking studs 305, 306 engaging, a movement of the contact element opposite to the plug-in direction is produced, characterised by an arrow R in FIG. 3 and FIG. 4. After the complete engagement of the locking studs 305, 306 with the secondary locking recess 205, 206, produced by a force exerted along a direction designated by arrow 301 in FIG. 3, the contact element 300 is fixed and arrested in the base element of the plug-in connector 200. The exertion of a movement of the contact element 200 in the base element of the plug-in connector 110, acting opposite to the plug-in direction R, also has at the same time the effect that a fixing element 215 arranged at the contact element (cf. FIG. 6, FIG. 7) engages with a mating recess 115 of the base element of the plug-in connector 110 and there takes its bearing (FIG. 1, FIG. 2) at a locating surface 116, by executing a bias. Such bias effects a fixing of the contact element 200 in the base element of the plug-in connector 110 in a second position. In this way, the contact element 200 is fixed in the base element of the plug-in connector 110 in two places, on the one hand through the secondary locking by means of the studs 305, 306 in the corresponding cone-shaped openings 205, 206 in the contact element 200, and, on the other hand, through the fixing element 215 in the openings 115 of the biased base element of the plug-in connector 110. The fixing through the fixing element 215 has the effect, in particular, that, even if the operational mode of the plug-in connector 100 is exposed to strong vibrations or shaking motions, no fracture of the contact element 200 occurs, for instance, in the area right between the secondary locking recesses 205, 206 and the crimp wings 240, and that, in particular, no contact corrosion in the crimp region appears due to constant very strong vibrations. The contact element 200 and, in particular, the crimp region is in fact held in a completely immovable and fixed manner in its position in the base element of the plug-in connector 110, including in case of vibrations.

The base element of the plug-in connector 110 features, in a well-known manner, a primary locking recess 127 which can be produced through injection moulding or through milling and the like. The secondary looking element 300 features, at the side of the contact element 200 that is facing the contact springs 210, that is, at the side of the connector, a coding rib 330 which extends in the plug-in direction R. This at least one coding rib 330 is to prevent wrong plugging if the secondary locking element 300 is already placed in locked position.

Moreover, a coding element 111 can also be arranged at the base element of the plug-in connector 110, which is to prevent, in particular, a wrong orientation of the plug-in connector in relation to a corresponding plug-in connector (not represented). Such coding element 111 also acts in conjunction with the secondary locking element 300. This is because a coding surface 332 is arranged on the face side of the coding rib 330, which is to prevent the plugging of the plug-in connector if the secondary locking element 300 is placed outside the locked position, such as represented in FIG. 1 and FIG. 3. In this case, a complementary plug-in connector (not represented) strikes against the coding surface 332. The coding rib 330 aligns with the coding element 111 of the base element of the plug-in connector 110 in locked position only (represented in FIG. 2 and FIG. 4), and the coding surface 332 no longer projects above this coding element 111. In this case, the secondary locking element 300 lies in a secondary locking element recess 119 arranged in the base element of the plug-in connector 110, and is taken in by it.

Furthermore, coding ribs 191, 192 are also arranged in the base element of the plug-in connector 110, which are to prevent wrong plugging with a further corresponding plug-in connector (FIG. 5).

The contact element 200 features, at the side that is facing the contact elements, which in the case demonstrated are spring elements 210, a basically rectangular positioning frame 211 with an opening 212. This positioning frame is received in a corresponding recess 123 of the base element of the plug-in connection 110 and allows for exact positioning of the spring elements 210, in a well-known manner.

Moreover, the contact element 200 features a detent spring 220 which is compressed into the primary locking recess 127, also in a well-known manner, with the contact element 200 in an inserted position, and prevents the contact element 200 at a primary locking bearing 128 from being extracted , in a well-known manner.

As represented in FIG. 6 and FIG. 7, in particular, the fixing element 215 is arranged at a curved deflection 216 which encloses an angle of 90° with the plug-in direction R. The advantage of this is that the opening is easily accessible for introducing a cable 204. The cable is bared in a well-known manner, in which the bared part in the crimp region 240 is contacted by crimps. The non-bared cable coating is clamped in a clamping area 243 and a pull relief is thus furnished.

The advantage of the plug-in connector 100 described above consists in that, through the fixing of the plug-in connector via a primary locking element composed of a spring 220 and a primary locking bearing 125, a secondary locking element composed of secondary locking recesses 205, 206 that are designed in a cone-shaped manner, and studs 305, 306 of the secondary locking element 300 of which at least one is (slightly) oversized compared to a secondary locking recess 205, and composed of the fixing element 215 which engages with a corresponding mating recess 115 in the base element of the secondary locking 110 and conveys a biased fixing of the contact element 200 in the base element of the plug-in connector 110, a fixing and arrest at several points of the contact element 200 is achieved in the base element of the plug-in connector 110 and also, in particular, at the end of the crimp region. In this, the curved rectangular deflection 216 proves to be of particular advantage, also in respect of the execution of the bias, as a spring effect can be achieved. In this way, the contact element 200 is fixed at two points, disposed at a distance from each other, namely the secondary locking composed of the secondary locking recess 205, 206, and the studs 305, 306, and the fixing element 215, arranged at the end of the crimp region, which engages with the mating opening 115 of the base element of the secondary locking 110. Hereby, vibration of the crimp region 240 and of the clamping area 242 is prevented, which could lead to disturbing contact corrosion and thus to an interruption of the electrical contact due to resistance increase, or even to a fracture of the contact element 200.

The fixing element is basically T-shaped. This not only increases the bearing surface in the plug-in direction, but an optimal arrest perpendicularly to the plug-in direction is conveyed also.

It should be mentioned at this point that the number of secondary locking recesses 205, 206 is chosen depending on the extraction force. For a smaller extraction force, one is sufficient, whereas for a bigger extraction force, two recesses are chosen. Moreover, more than two recesses could also be provided.

The invention claimed is:

1. Plug-in connector (100) comprising at least one contact element (200) arranged in a base element (110) of the plug-in connector, and a crimp connection, in which at least one secondary locking recess (205, 206) is arranged in the contact element (200), extending transversely to the plug-in direction (R), is provided, with which a locking stud (305, 306) of a secondary locking element (300) engages, the secondary locking element (300) being in locked position, and further comprising a fixing element (215) which is arranged at the end of a crimp region and which engages with a mating recess (115) in the base element (110) of the plug-in connector.

2. Plug-in connector (100) as per claim 1, wherein at least one secondary locking recess (205, 206) is formed in a cone-shaped manner and wherein the locking stud (305) is oversized in relation to the secondary locking recess (205), so that, at the moment of the locking stud (305) engaging with the secondary locking recess, a clamping of the locking stud (305) in the secondary locking recess (205) is produced, with a simultaneous movement of the contact element in the base element of the plug-in connector, parallel to the plug-in direction (R).

3. Plug-in connector (100) as per claim 1, wherein the fixing element (215), through the movement of the contact element (200) parallel to the plug-in direction (R), takes its bearing at a surface (116) of the mating recess (215) in the base element (110) of the plug-in connector, executing a bias.

4. Plug-in connector (100) as per claim 1, wherein the fixing element (215) is arranged at a deflection (216) basically extending perpendicularly to the plug-in direction (R).

5. Plug-in connector (100) as per claim 4, wherein the deflection (216) encloses an angle of 90° with the plug-in direction (R).

6. Plug-in connector (100) as per claim 1, wherein the fixing element (215) is basically T-shaped.

7. Plug-in connector (100) as per claim 1, wherein a detent spring (220) is arranged at the contact element (200) for compression in a primary locking recess (127) provided in the base element (110) of the plug-in connector.

8. Plug-in connector (100) as per claim 1, wherein the number of secondary locking recesses (205, 206) is determined depending on the extraction force specified.

9. Plug-in connector (100) as per claim 1, wherein the secondary locking element recess (119) is provided in the base element (110) of the plug-in connector, which takes in the secondary locking element (300) in locked position.

10. Plug-in connector (100) as per claim 1, wherein the secondary locking element (300) features a coding surface (332) at the leading end, which prevents the plug-in connector (100) from plugging if the secondary locking element (300) is placed outside the locked position.

11. Plug-in connector (100) as per claim 1, at least one coding rib (330) is provided in the front area of the secondary locking element (300), extending in plug-in direction (R).

* * * * *